US009290025B2

(12) United States Patent
Lo et al.

(10) Patent No.: US 9,290,025 B2
(45) Date of Patent: Mar. 22, 2016

(54) MEDIA HANDLING SYSTEM

(75) Inventors: Kevin Lo, Vancouver, WA (US); Daniel Fredrickson, Portland, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/397,085

(22) PCT Filed: Jun. 28, 2012

(86) PCT No.: PCT/US2012/044641

§ 371 (c)(1),
(2), (4) Date: Oct. 24, 2014

(87) PCT Pub. No.: WO2014/003760

PCT Pub. Date: Jan. 3, 2014

(65) Prior Publication Data

US 2015/0103112 A1 Apr. 16, 2015

(51) Int. Cl.

| | |
|---|---|
| ***G03G 21/18*** | (2006.01) |
| ***B41J 13/00*** | (2006.01) |
| ***B41J 3/60*** | (2006.01) |

(52) U.S. Cl.

CPC ..... *B41J 13/0009* (2013.01); *B41J 3/60* (2013.01)

(58) Field of Classification Search

USPC ..... 347/16, 5, 9; 399/113, 124

See application file for complete search history.

(56) References Cited

U.S. PATENT DOCUMENTS

| | | | | |
|---|---|---|---|---|
| 5,337,135 | A | 8/1994 | Malachowski et al. | |
| 6,669,189 | B2 | 12/2003 | Seto et al. | |
| 7,218,876 | B2 | 5/2007 | Federico et al. | |
| 2007/0146789 | A1 | 6/2007 | Mima et al. | |
| 2010/0166455 | A1 * | 7/2010 | Mori et al. | 399/113 |
| 2011/0085838 | A1 | 4/2011 | Won | |

FOREIGN PATENT DOCUMENTS

| | | |
|---|---|---|
| JP | 2003-237981 | 8/2003 |
| JP | 2006176232 | 7/2006 |
| JP | 2011-236030 | 6/2007 |
| KR | 10-0729625 | 6/2007 |

OTHER PUBLICATIONS

International Search Authority, PCT Search Report mail date Feb. 8, 2013. Application No. PCT/US2012/044641 filed date Jun. 28, 2012.

* cited by examiner

*Primary Examiner* — Lam Nguyen

(74) *Attorney, Agent, or Firm* — HP Inc-Patent Department

(57) ABSTRACT

A media handling system is disclosed herein. An example includes media path, a transport assembly to move print media through the media path, a processor, and a non-transitory storage medium including instructions that cause the processor to control the transport assembly to: move a first medium and second through the media path, overlap a trailing portion of the first medium and a leading portion of the second medium within the media path, overlap a leading portion of the first medium and a trailing portion of the second medium within the media path, and overlap the trailing portion of the first medium and the leading portion of the second medium during a time that the leading portion of the first medium and the trailing portion of the second medium is also overlapped. A method of media handling is also disclosed herein as is a non-transitory storage medium.

20 Claims, 13 Drawing Sheets

MEDIA HANDLING SYSTEM

BACKGROUND

Consumers appreciate speed and reliability in printing devices. They also appreciate a range of features in printing devices, such as the ability to print on both sides of print media. This can not only save print media which is environmentally beneficial, but also reduce the cost of operation of such printing devices due to the use of less print media. Printing device designers and manufacturers may, therefore, endeavor to provide such printing devices to these consumers.

BRIEF DESCRIPTION OF THE DRAWINGS

The following detailed description references the drawings, wherein.

DETAILED DESCRIPTION

Duplex printing may be performed one sheet at a time. This, however, limits the speed of printing as a printing device must flip a print medium (e.g., sheet) over before printing the other side. This may cause the throughput of single sheet duplex printing, in terms of sheets per minute, to be approximately 40% to 60% that of simplex printing.

A solution to this printing device speed or throughput reduction during duplex printing is to have more than one print medium moving inside the printing device at a time. This allows a second medium to follow a first medium before printing of the first medium is completed by the printing device. Printing device duplex throughput may then increase to approximately 70% to 90% that of simplex printing.

One way to do this is to interleave the first medium and the second medium within a media path of the printing device. However, several design challenges can exist with this approach. For example, increased size of the printing device due to a lengthened print media path. As another example, increased design and operational complexity due to the use of active buffers and/or additional components (e.g., rollers and guides) of a print media transport assembly of the printing device. As an additional example, added cost to the consumer due to the above-noted increased number of components, as well as increased manufacturing complexity. As a further example, decreased printing device reliability due to malfunction of the active buffers and/or additional components utilized in such interleaving.

Figure 1:
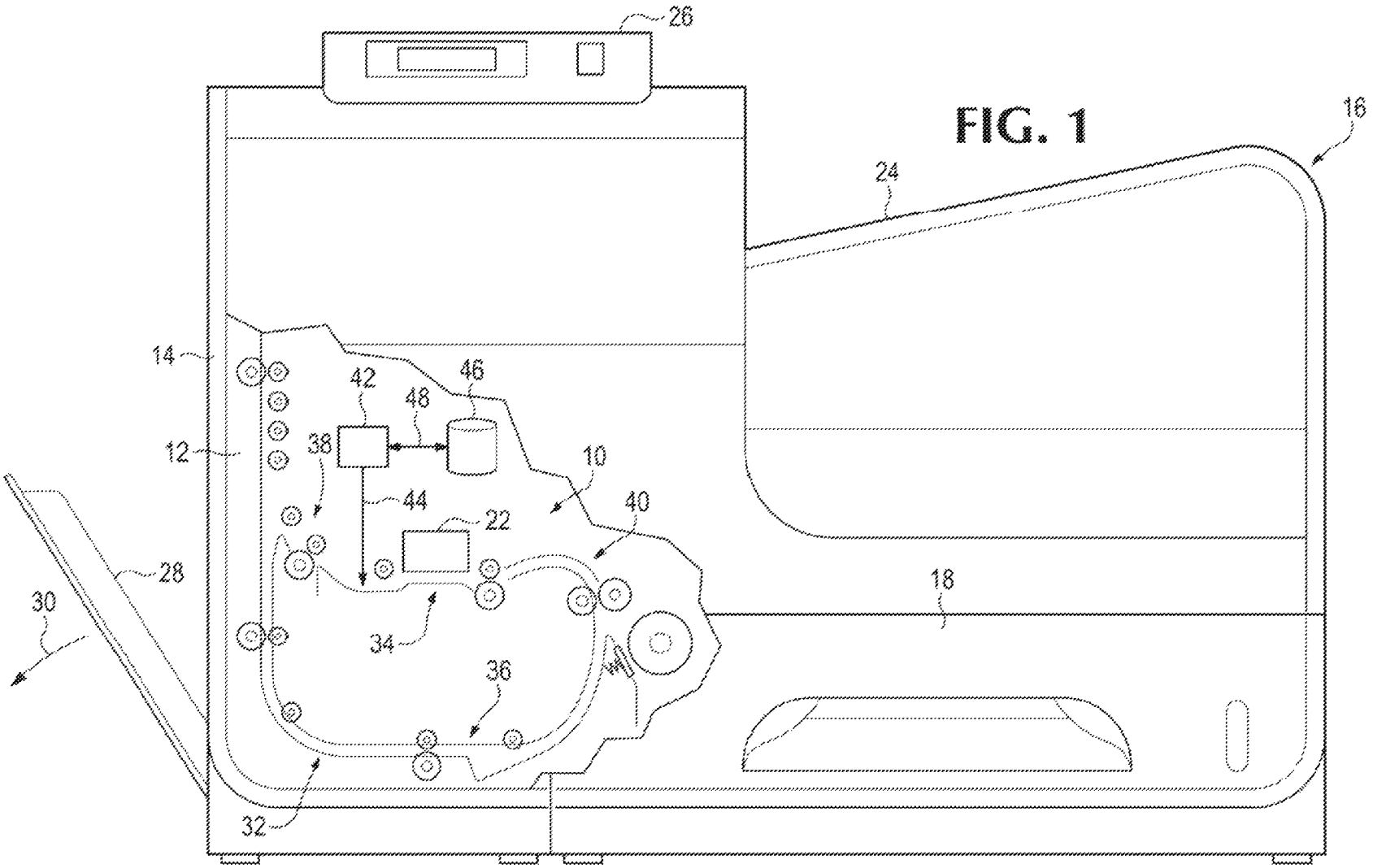
FIG. 1 is an example of a printing device including a media handling system.

A media handling system and method of media handling that addressed these design challenges would be a welcome improvement. An example of such a media handling system 10 is illustrated in FIG. 1.

As used herein, the terms "non-transitory storage medium" and non-transitory computer-readable storage medium" are defined as including, but not necessarily being limited to, any media that can contain, store, or maintain programs, information, and data. Non-transitory storage medium and non-transitory computer-readable storage medium may include any one of many physical media such as, for example, electronic, magnetic, optical, electromagnetic, or semiconductor media. More specific examples of suitable non-transitory storage medium and non-transitory computer-readable storage medium include, but are not limited to, a magnetic computer diskette such as floppy diskettes or hard drives, magnetic tape, a random access memory (RAM), a read-only memory (ROM), an erasable programmable read-only memory (EPROM), a flash drive, a compact disc (CD), or a digital video disk (DVD).

As used herein, the term "processor" is defined as including, but not necessarily being limited to, an instruction execution system such as a computer/processor based system, as Application Specific Integrated Circuit (ASIC), or a hardware and/or software system that can fetch or obtain the logic from a non-transitory storage medium or a non-transitory computer-readable storage medium and execute the instructions contained therein. "Processor" can also include any controller, state-machine, microprocessor, cloud-based utility, service or feature, or any other analogue, digital and/or mechanical implementation thereof.

As used herein "printing device" is defined as including, but not necessarily being limited to, a printer that uses any of the following marking technologies or a combination thereof: ink jet, laser jet, dye sublimation, liquid toner, off-set printing, impact, or dot matrix. As used herein "media" is defined as including, but not necessarily being limited to any type of paper or other printing medium (e.g., cloth, canvas, transparency, etc.), having any type of finish on either or both sides (e.g., glossy, matte, plain, textured, etc.), in any size, shape, color, or form (e.g., sheet, roll (cut or uncut), folded, etc.).

As used herein "printing composition" is defined as including, but not necessarily being limited to, ink or toner that is deposited or placed on media in a print zone of a printing device. As used herein, "duplex" or "duplex printing" is defined as including, but not necessarily being limited to, depositing printing composition on both sides of a medium, rather than just one side, which may be referred to as simplex printing.

Referring again to FIG. 1, media handling system 10 is located in an interior 12 defined by a housing 14 of a printing device 16. As can be seen in FIG. 1, media handling system 10 is positioned adjacent an input tray 18 of priming device 16. Input tray 18 holds sheets of media 20 (see, e.g., FIG. 2) for selection and transport by media handling system 10 from input tray 18, past print zone 22, to output tray or shelf 24, where printed media is collected for retrieval by one or more end users. A user interface 25 provides information (e.g., print job status, supplies status, etc.) to one or more end users of printing device 16, as well as allowing such end users to enter information (e.g., user ID, print job ID, etc.) relating to their use of printing device 16.

A door 28 may be opened by manually moving it in the direction of arrow 30. Opening door 28 allows access to interior 12 of printing device 16. This access may be necessary in the unlikely event an end user needs to clear a medium jam in media handling system 10 caused, tor example, by a buckle or fold of a medium. Door 28 may be closed by moving it in a direction generally opposite that of arrow 30.

As can also be seen in FIG. 1, media handling system 10 includes a media path 32, having a print zone portion 34 where printing composition is deposited on media within print zone 22, a duplex portion 36, and an output portion 38 where media may be moved to output tray or shelf 24. A transport assembly 40, discussed in more detail below, moves print media through media path 32. As can additionally be seen in FIG. 1, media handling system 10 also includes a processor 42 that controls transport assembly 40, as generally indicated by arrow 44. A non-transitory storage medium 46 includes instructions that are utilised by processor 42, as generally indicated by double-headed arrow 48, to control transport assembly 40. Processor 42 may additionally write data to non-transitory storage medium 46, as also generally indicated by double-headed arrow 48.

Figure 2:
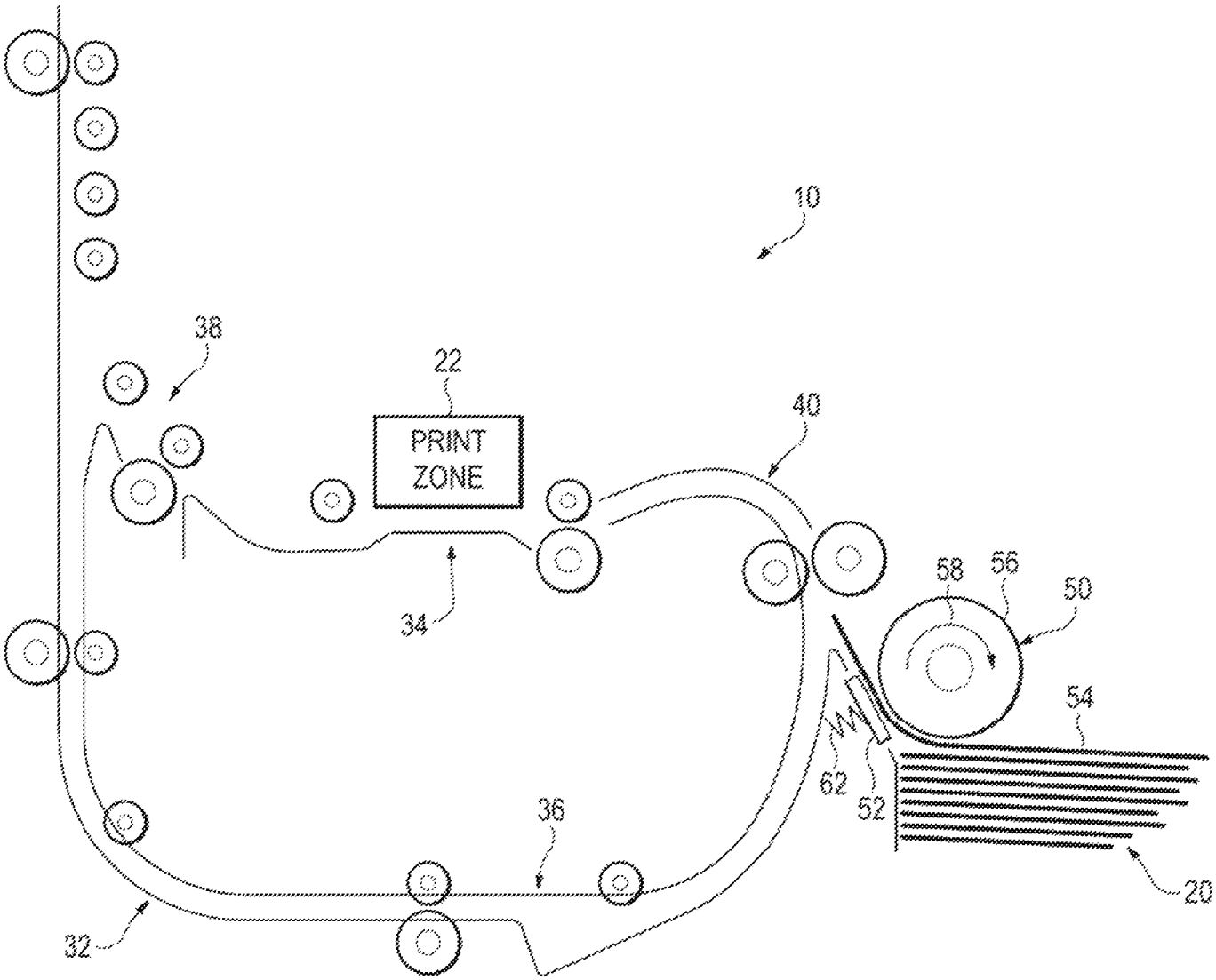
FIG. 2 is the example of the media handling system of FIG. 1 selecting a first medium from a media stack.

Media handling system 10 is shown in FIG. 2 without some of its components, such as processor 42 and non-transitory storage medium 46. As can be seen in FIG. 2, transport assembly 40 includes a pick assembly 50 and a separator assembly 52 (in this example a separator pad) that are designed to select a sheet of medium, such as first medium 54, from the stack of media 20. This is accomplished by rotating pick roller 56 of pick assembly 50 in the direction of arrow 58 to select a sheet of medium from media stack 20 and utilizing separator assembly 52, which is biased by biasing member 62, to push back any additional sheets of medium inadvertently selected by pick roller 56 onto media stack 20, also known as singulating or singulation.

Figure 3:
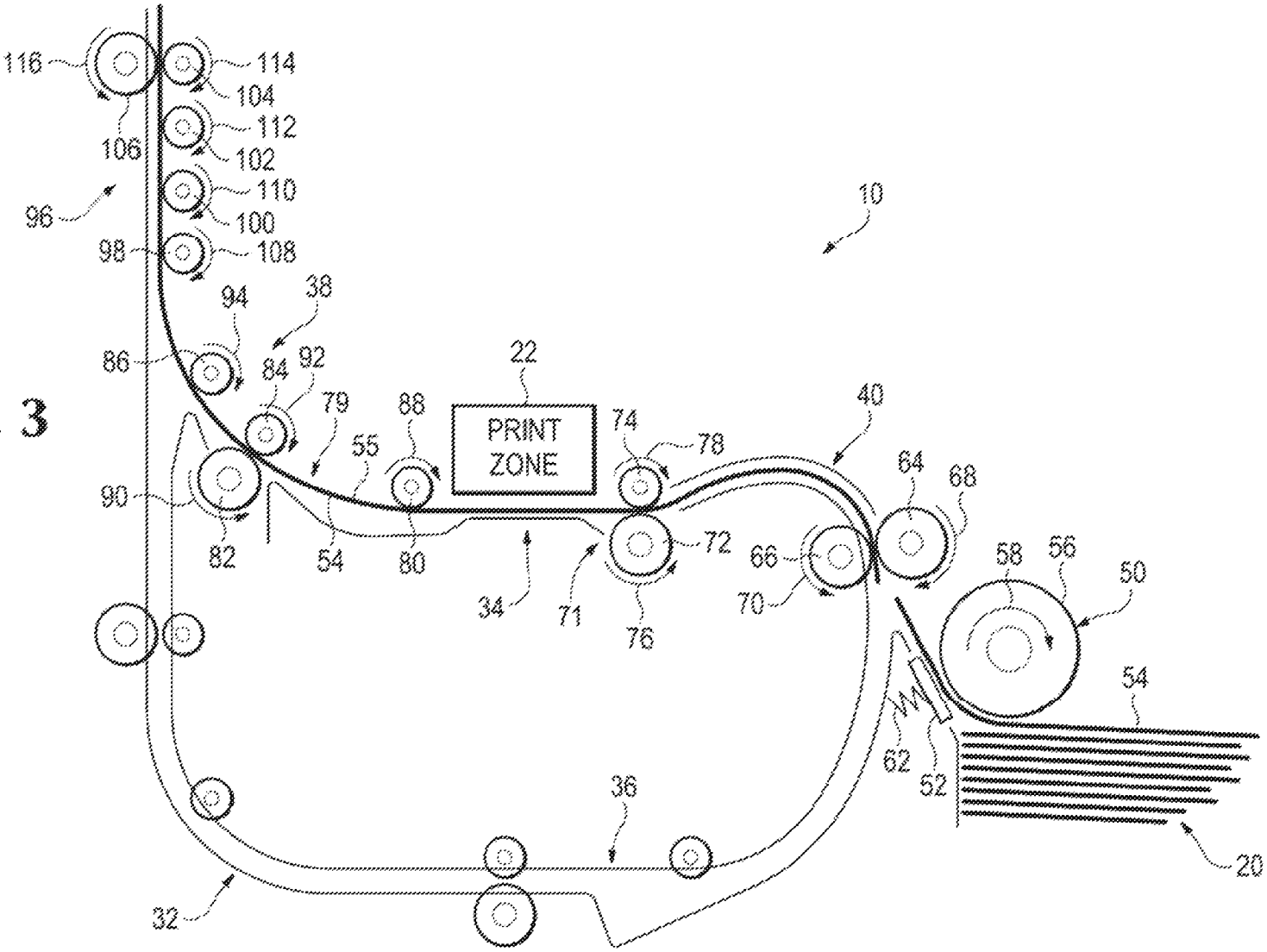
FIG. 3 is the example of the media handling system of FIG. 2 transporting the first medium past a print zone portion of a media path toward an output portion of the media path.

An example of media handling system 10 transporting first medium 54 past print zone portion 34 of media path 32 toward an output portion 38 is shows in FIG. 3. As can be seen in FIG. 3, transport assembly 40 also includes a pair of turn rollers 64 and 66, that rotate in the direction of arrows 68 and 70, and feed assembly 71 that includes a pair of feed rollers 72 and 74, that rotate in the direction of respective arrows 76 and 78, to help move media, such as first medium 54, within media path 32 toward print zone portion 34 where a first side 55 thereof may have printing composition deposited thereon. As can also be seen in FIG. 3, transport assembly 40 additionally includes an output assembly 79 having starwheel rollers 80 and 86 and output rollers 82 and 84 that rotate in the direction of arrows 88, 90, 92, and 94, to help move media, such as first medium 54, out of or away from print zone potion 34 of media path 32 toward eject portion 96 of transport assembly 40.

As can additionally be seen in FIG. 3, eject portion 96 of transport assembly 40 includes starwheels 98, 100, and 102 and rollers 104 and 106 that rotate in the direction of arrows 108, 110, 112, 114, and 116, to help move media, such as first medium 54, along media path 32 toward output tray or shelf 24. As can further be seen in FIG. 3, pick roller 56 of pick assembly 50 and the separator pad of separator assembly 52 are respectively selecting and singulating a second medium 118 from media stack 20.

Figure 4:
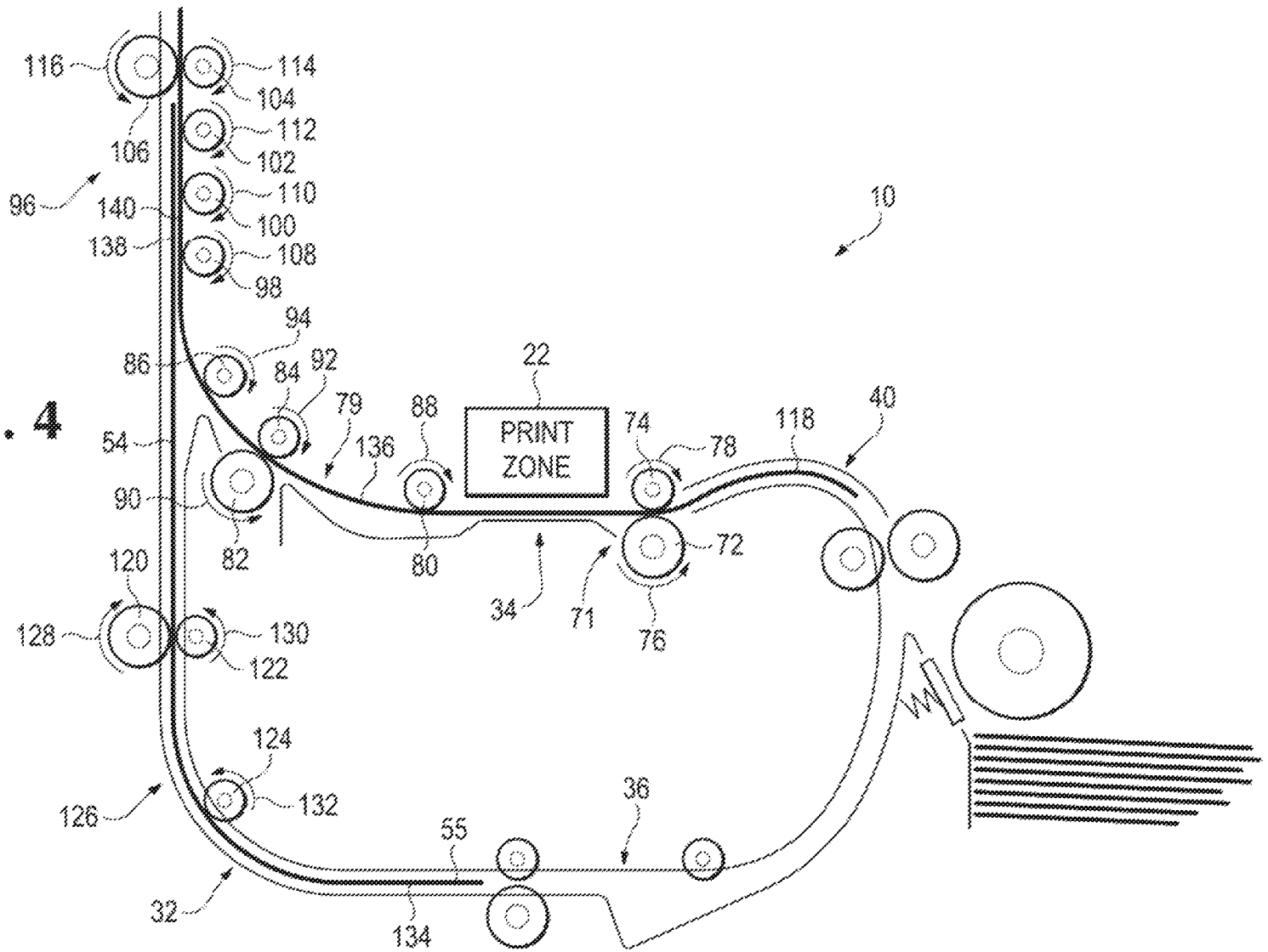
FIG. 4 is an example of the media handling system of FIG. 3 transporting the first medium into a duplex portion of the media path.

An example of the media handling system 10 of transport assembly 40 moving first medium 54 out of eject portion 96 and toward duplex portion 36 of media path 32 is shown in FIG. 4. As can be seen in FIG. 4, duplex rollers 120 and 122 and starwheel 124 of duplex assembly 126 are rotating in the direction of respective arrows 128, 130, and 132. This rotation helps move media, such as first medium 54, from eject portion 96 and output portion 38 of media path 32 toward duplex portion 36 in preparation for deposition of printing composition on second side 134 of first medium 54. As can also be seen in FIG. 4, feed rollers 72 and 74 of feed assembly 71 are moving second medium 118 through print zone portion 34 of media path 32 where printing composition may be deposited on first side 136 of second medium 118 in print zone 22. Output rollers 82 and 84 and starwheels 80 and 86 of output assembly 79 are also rotating in the direction of arrows 88, 90, 92, and 94 to help move media, such as second medium 118, out of or away from print zone potion 34 of media path 32 toward eject portion 96 of transport assembly 40.

As can further be seen in FIG. 4, trailing portion 138 of first medium 54 is overlapped with leading portion 140 of second medium 118 within media path 32, as shown. This overlap helps reduce the size of media handling system 10 that is required for duplex printing if first medium 54 and second medium 118 were not overlapped. Additionally, this overlap also helps reduce the overall cost of printing device 10 because fewer materials are required.

Figure 5:
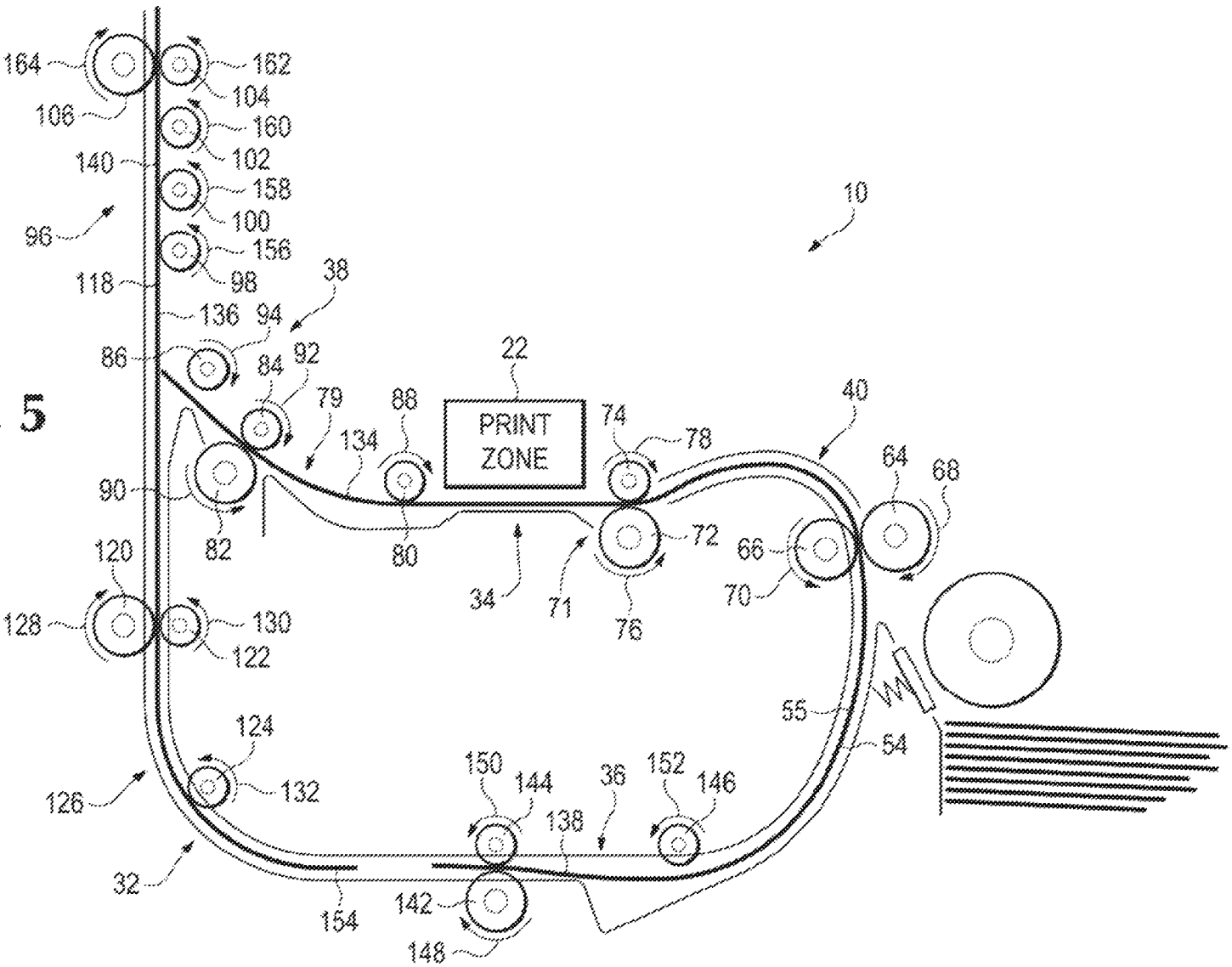
FIG. 5 is an example of the media handling system of FIG. 4 transporting the first medium past the print zone for second side printing and the second medium into the duplex portion of the media path.

An example of media handling system 10 transporting the first medium 54 past print zone 22 for second side 134 printing and the second medium into the duplex portion 36 of the media path 32 is shown in FIG. 5. As can be seen in FIG. 5, duplex assembly 126 includes additional duplex rollers 142 and 144 and starwheel 146 rotating in the direction of arrows 148, 150, and 152 that further help move media, such as first medium 54, from duplex portion 36 of media path 32 toward print zone portion 34 for deposition of printing composition on second side 134 of first medium 54. As can also be seen in FIG. 5, duplex rollers 120 and 122 and starwheel 124 of duplex assembly 126 are rotating in the direction of arrows 128, 130, and 132 to move second medium 118 out of eject portion 96 and output portion 38 toward duplex portion 36 of media path 32 in preparation for deposition of printing composition on second side 154 of second medium 118. Eject rollers 104 and 106 and starwheels 98, 100, and 102 are additionally rotating in the direction of arrows 156, 158, 160, 162, and 164 to also assist in moving second medium 118 out of eject portion 96 toward duplex portion 36.

As can additionally be seen in FIG. 5, feed rollers 72 and 74 of feed assembly 71 are moving first medium 54 through print zone portion 34 of media path 32 where printing composition may be deposited on second side 134 of first medium 54 in print zone 22. Output rollers 82 and 84 and starwheels 80 and 86 of output assembly 79 are also rotating in the direction of arrows 88, 90, 92, and 94 to help move media, such as first mediums 54, out of or away from print zone potion 34 of media path 32 toward eject portion 96 of transport assembly 40.

Figure 6:
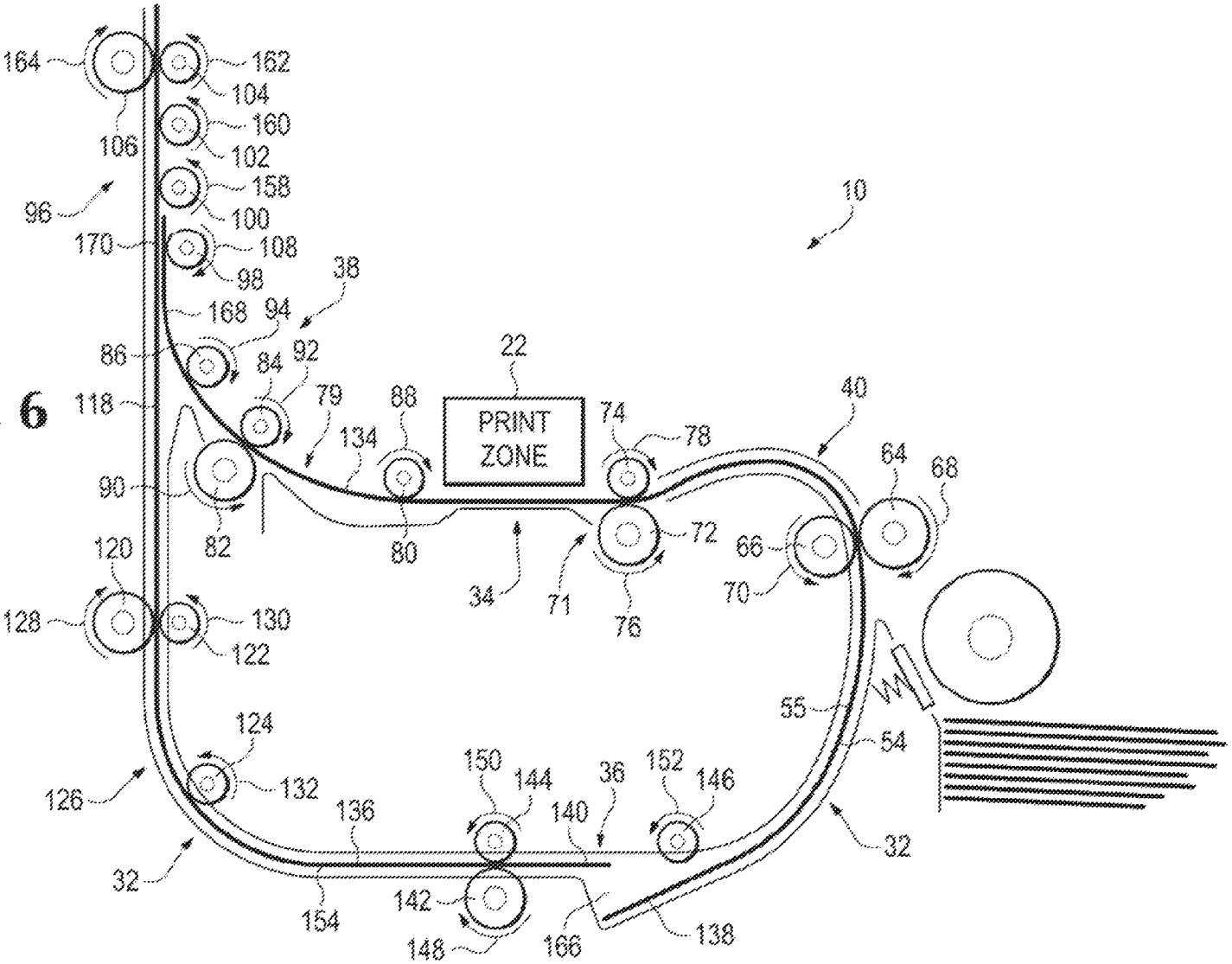
FIG. 6 is an example of the media handling system of FIG. 5 accelerating the second medium toward a passive buffer of the duplex portion of the media path.
Figure 7:
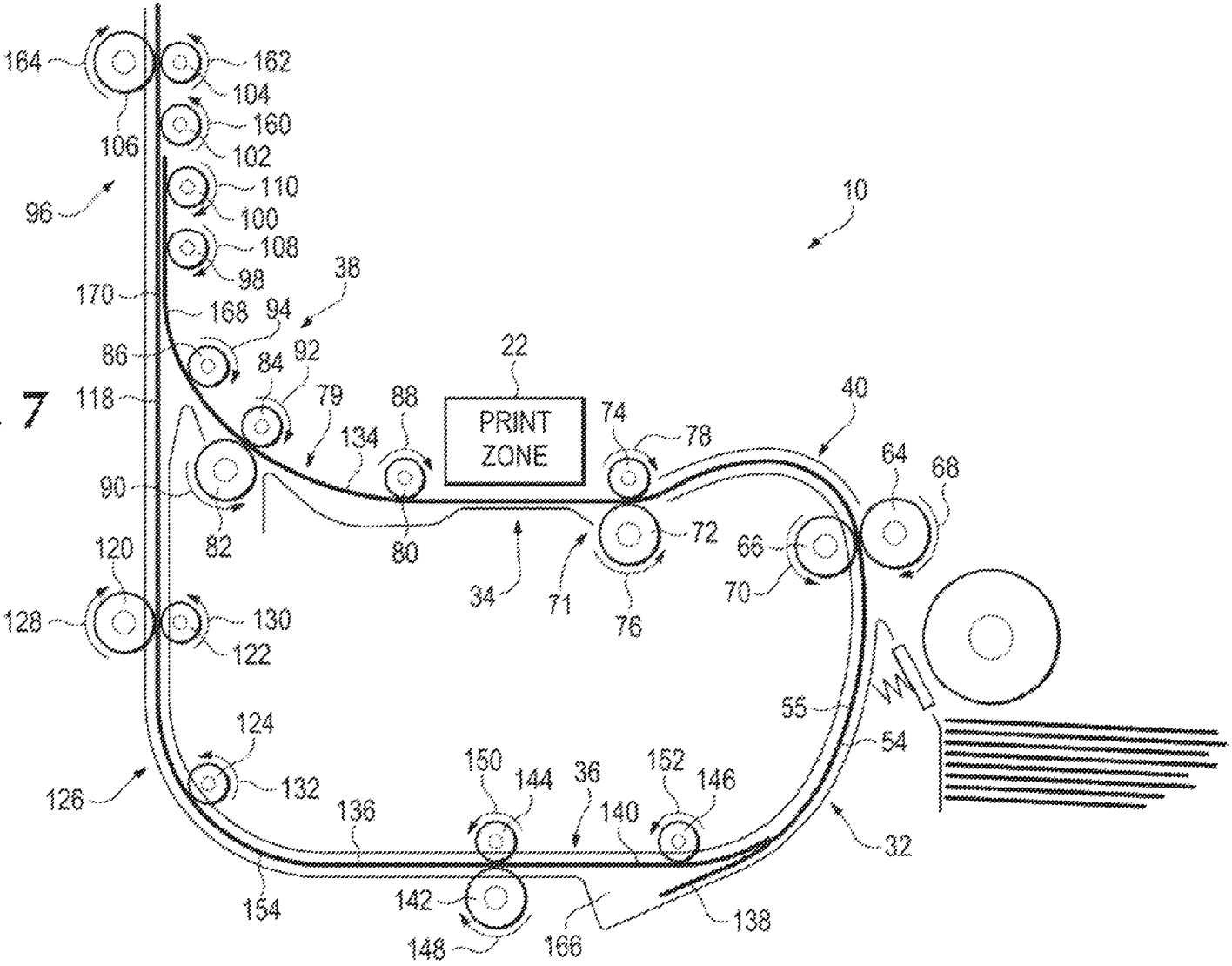
FIG. 7 is an example of overlap of a leading portion of the second medium and a trailing portion of the first medium in the passive buffer.

An example of media handling system 10 accelerating second medium 118 toward a passive buffer 166 of the duplex portion 36 of media path 32 is shown in FIG. 6. As can be seen in FIGS. 6 and 7, this acceleration of second medium 118 into passive buffer 166 results in an overlap of trailing portion 138 of first medium 54 and leading portion 140 of second medium 118. As can also be seen in FIGS. 6 and 7, leading portion 168 of first medium 54 and trailing portion 170 of second medium 118 are also overlapped within media path 32 near and between output portion 38 and eject portion 96. This overlap helps reduce the size of media handling system 10 that is required for duplex printing if first medium 54 and second medium 118 were not overlapped. Additionally, this overlap also helps reduce the overall cost of printing device 10 because fewer materials are required, for example, when active buffering is utilised instead. As can additionally be seen, this overlap allows the combined length of first medium 54 and second medium 118 to be greater than that of a length of media path 32.

Figure 8:
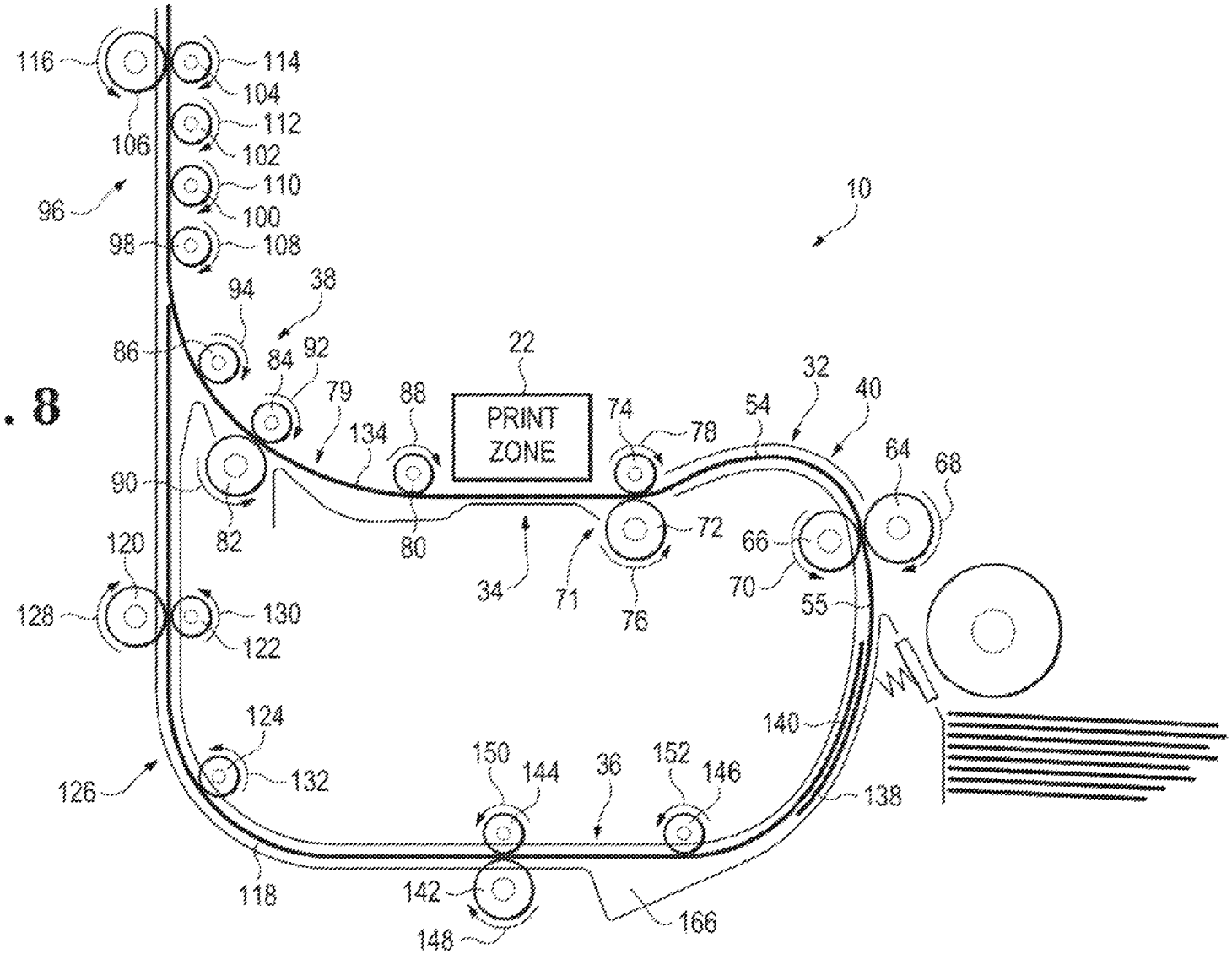
FIG. 8 is an example of overlap of the leading portion of the second medium and the trailing portion of the first medium outside of the passive buffer.

An example of overlap of leading portion 140 of second medium 118 and trailing portion 138 of first medium 54 outside of passive buffer 166 is shown in FIG. 8. This continued overlap occurs due to the different rates of movement of first medium 54 and second medium 118. More specifically, the relative rate of movement of first medium 54 to second medium 118. That is, first medium 54 is being moved through print zone portion 34 of media path 32 by transport assembly 40 at a substantially constant rate so that printing composition may be deposited on second side 134 thereof within print zone 22. Second medium 118, on the other hand, is moving relatively more quickly resulting is this continued overlap. In another example of a media handling system of the present invention, as claimed below, transport assembly 40 may pause second medium 118 at or in passive buffer 166 for a predetermined period of time before moving it again to the position shown in FIG. 9.

Figure 9:
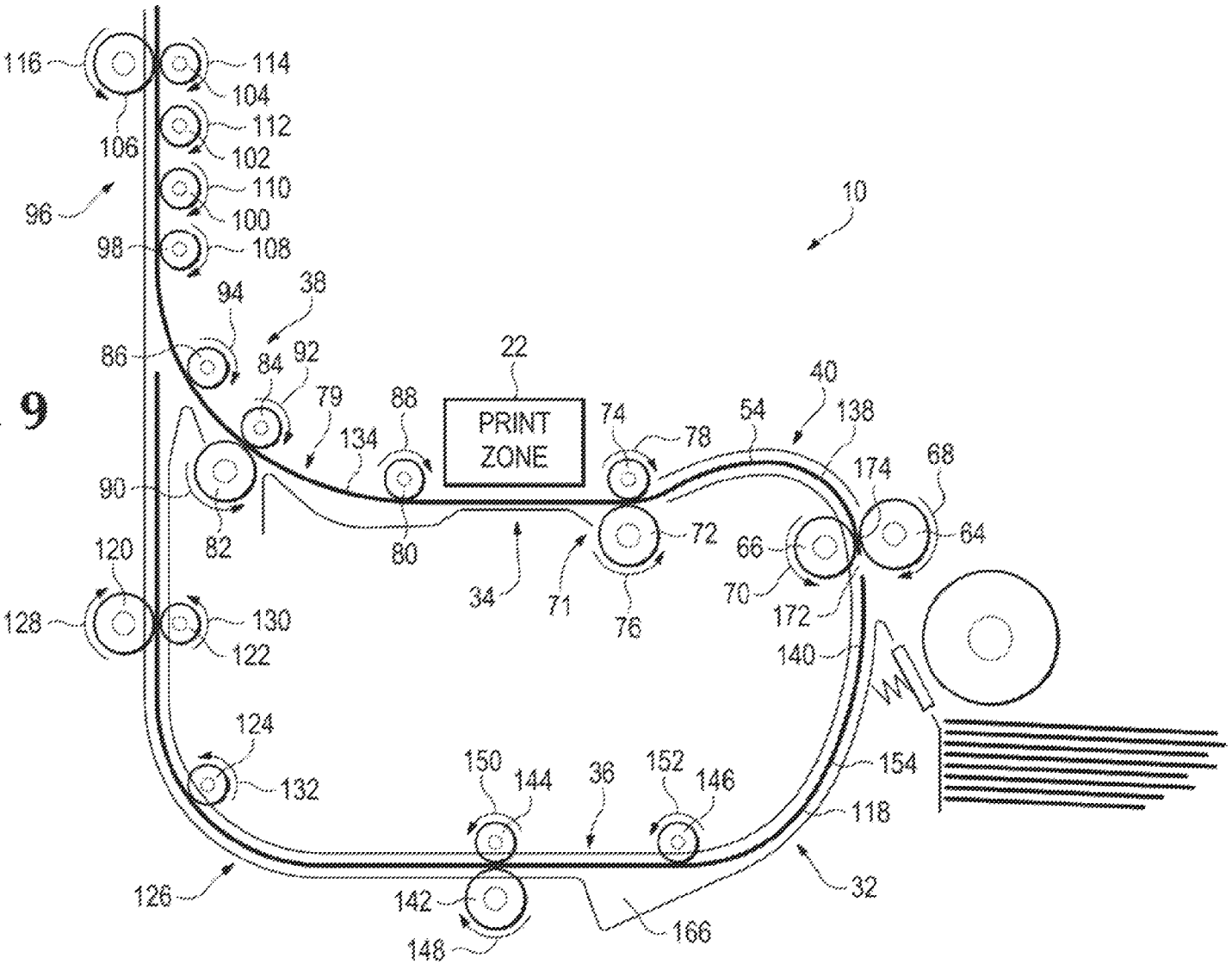
FIG. 9 is an example of the elimination of the overlap of the trailing portion of the first medium and the leading potion of the second medium.

As can be seen in FIG. 9, the overlap of the trailing portion 138 of first medium 54 and the leading potion 140 of second medium 118 is gone and a gap 172 now exists between them. As can also be seen, in FIG. 9, printing on second side 134 of first medium 54 is approximately half complete. As can additionally be seen in FIG. 9, second medium 118 is about to enter nip 174 between turn roller 64 and turn roller 66 for movement by transport assembly 40 through print zone portion 34 where printing composition will be deposited on second side 154 thereof.

Figure 10:
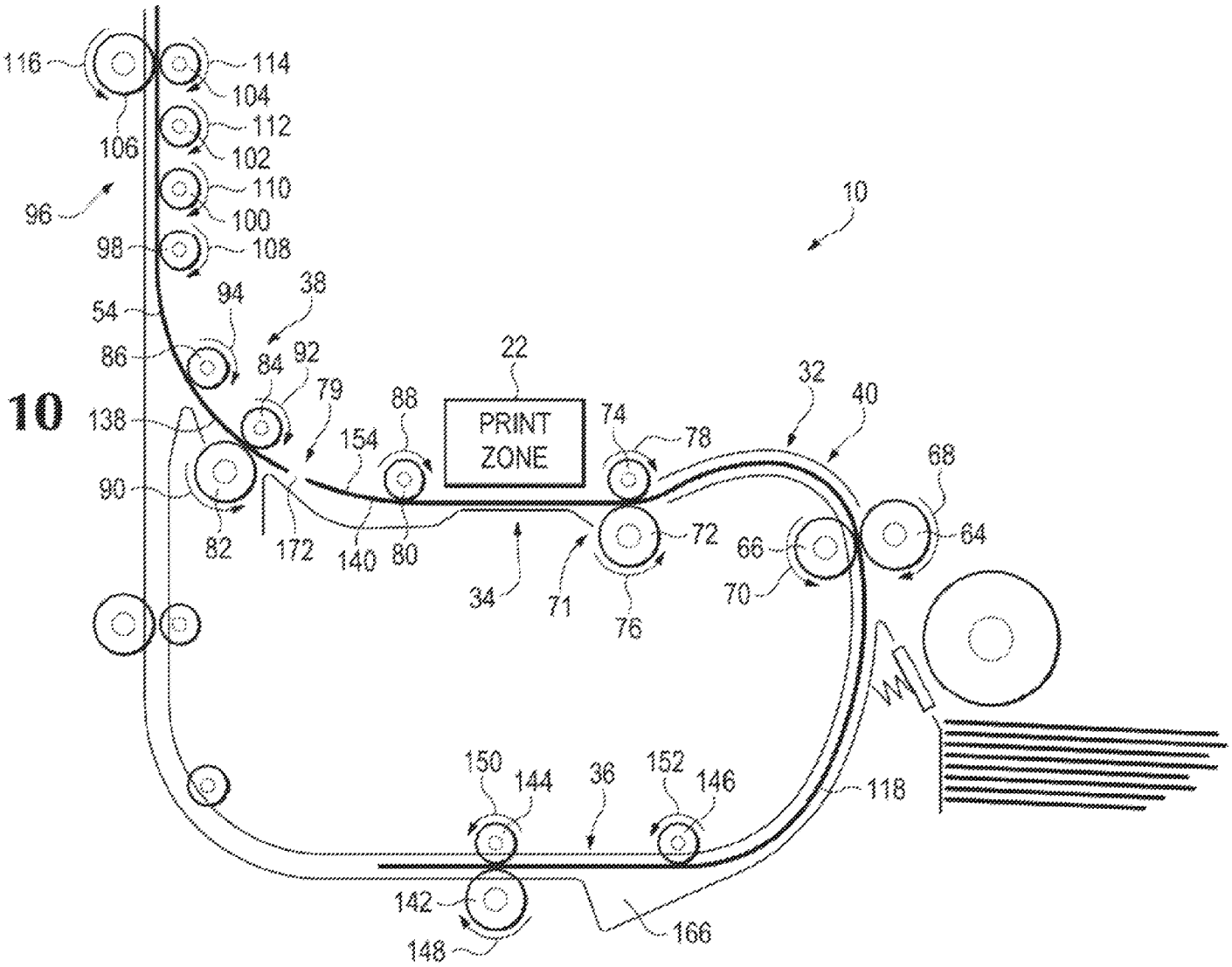
FIG. 10 is an example of completion of duplex printing on the first medium and printing on a second side of the second medium.

An example of completion of duplex printing on first medium 54 and printing on second side 154 of second medium 118 is shown in FIG. 10. As can be seen in FIG. 10, trailing portion 138 of first medium 54 is positioned between output roller 82 and output roller 84. Leading portion 168 (not shown in FIG. 10) of first medium 54 has already exited media handling system 10 and is adjacent output tray or shelf 24 (also not shown in FIG. 10). As can additionally be seen in FIG. 10, leading portion 140 of second medium 118 has exited print zone portion 34 and is headed toward output portion 38 of media path 32.

Figure 11:
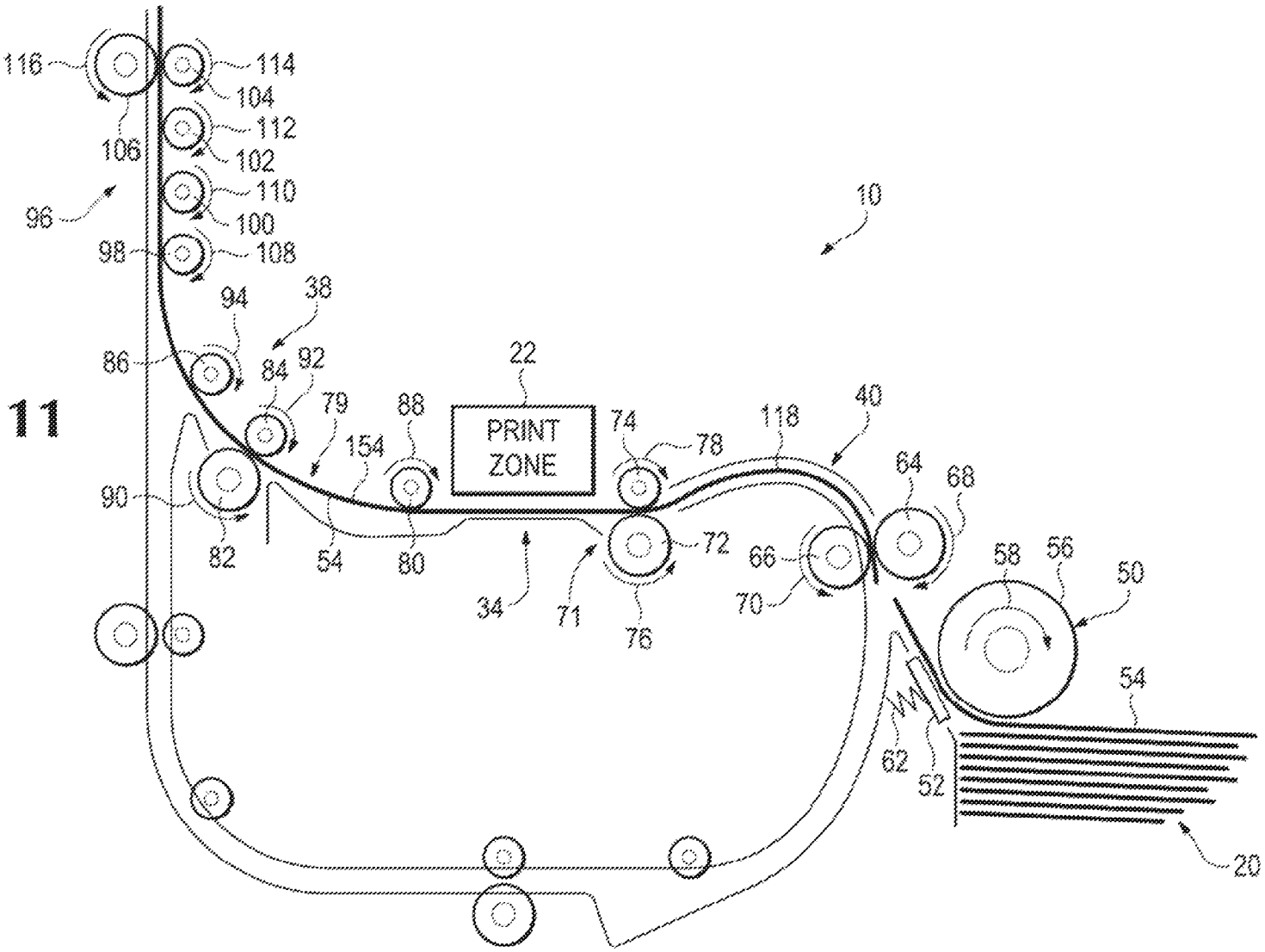
FIG. 11 is an example of the media handling system selecting a third medium from the media stack while the remainder of the second side of the second medium is being printed.

An example of media handling system 10 selecting a third medium 176 from media stack 20 while the remainder of second side 154 of second medium 118 is being printed in print zone 22 is shown in FIG. 11. Third medium 176 may be simplex or duplex printed depending upon an end user's particular preferences.

Figure 12:
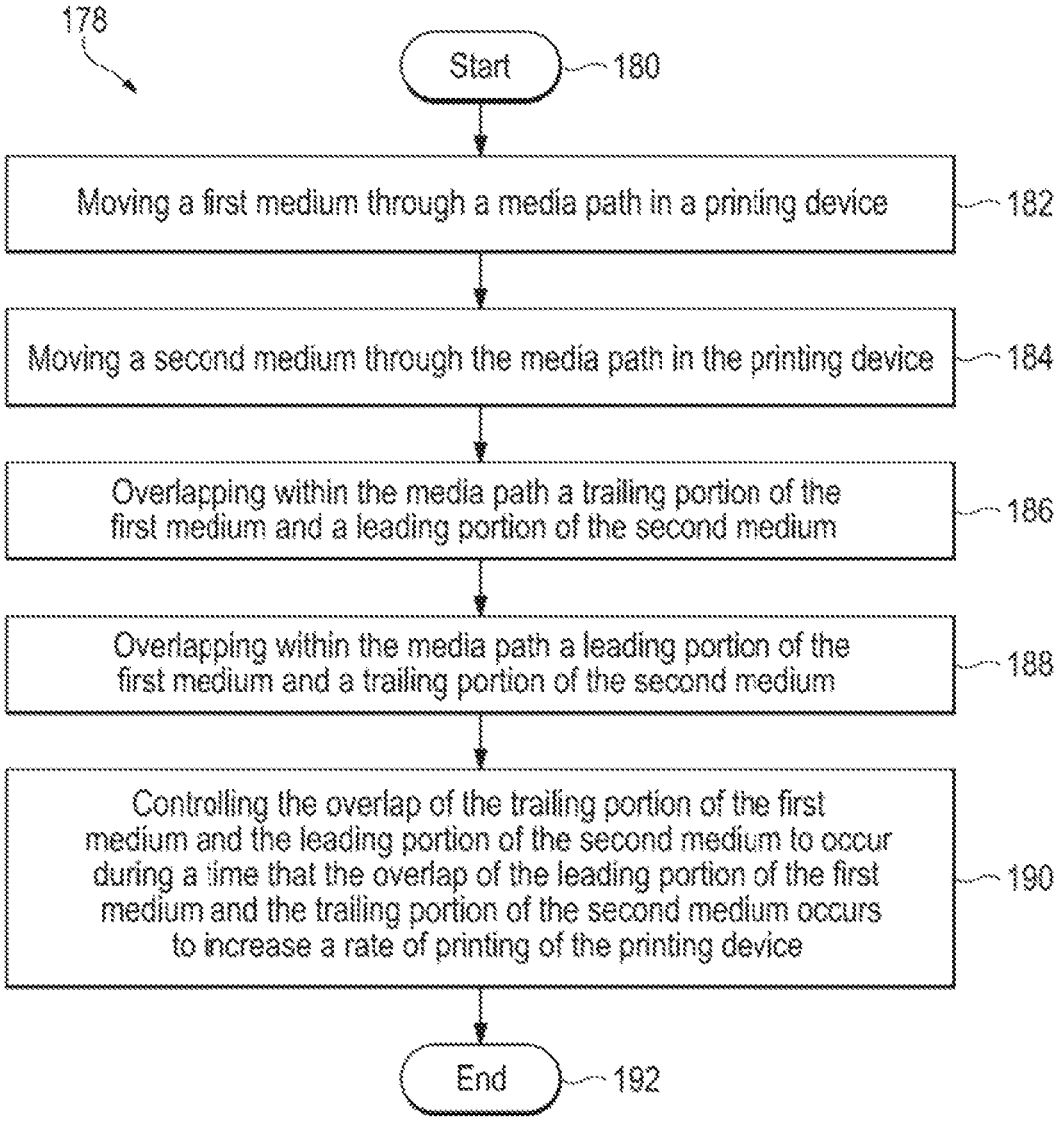
FIG. 12 is an example of a media handling method.

An example of a media handling method 178 is shown in FIG. 12. As can be seen in FIG. 12, method 178 starts 180 by moving a first medium through a media path in a printing device, as indicated by block 182, and moving a second medium through the media path in the printing device, as indicated by block 184. Method 178 continues by overlapping within the media path a trailing portion of the first medium and a leading portion of the second medium, as indicated by block 186, and overlapping within the media path a leading portion of the first medium and a trailing portion of the second medium, as indicated by block 188. Method 178 further continues by controlling the overlap of the trailing portion of the first medium and the leading portion of the second medium to occur during a time that the overlap of the leading portion of the first medium and the trailing portion of the second medium occurs to increase a rate of printing of the printing device, as indicated by block 190. Method 178 may then end 192.

Figure 13:
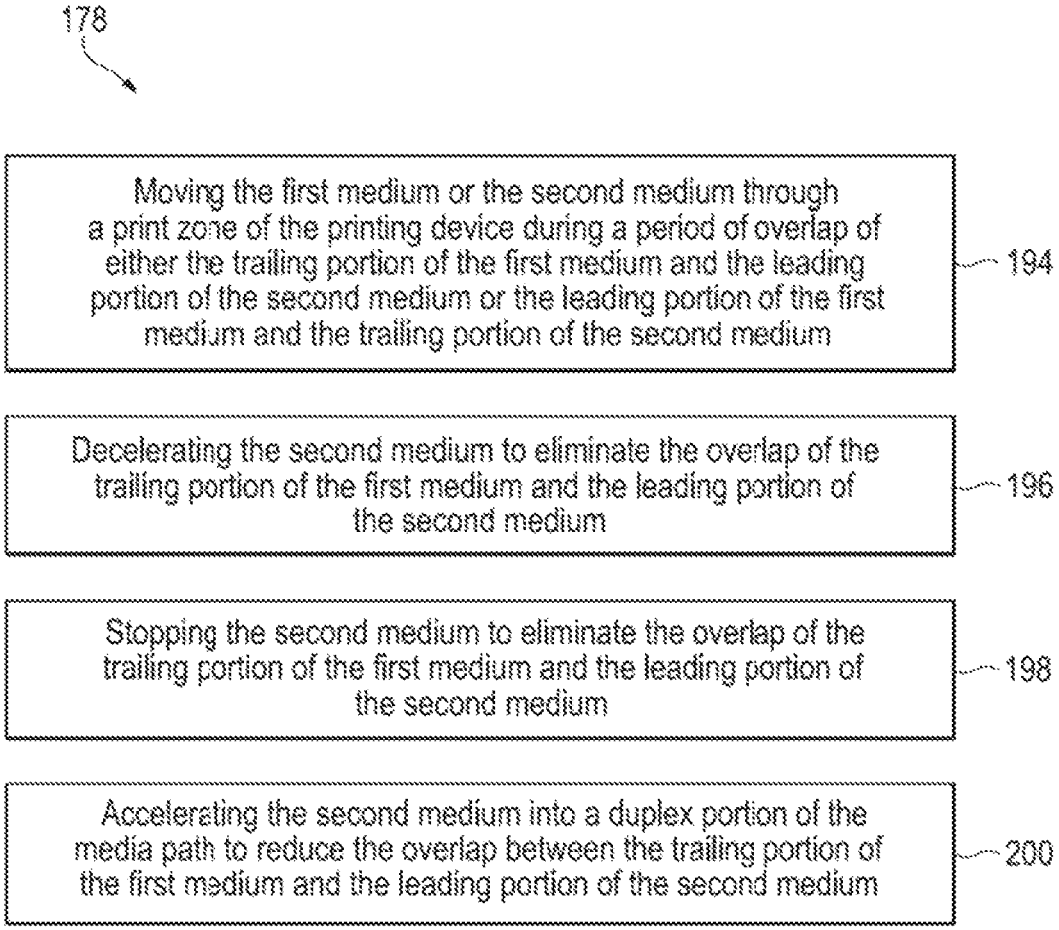
FIG. 13 is an example of additional elements of the media handling method of FIG. 12.

An example of additional elements of media handling method 178 are illustrated in FIG. 13. As can be seen in FIG. 13, method 178 may additionally include moving the first medium or the second medium through a print zone of the printing device during a period of overlap of the trailing portion of the first medium and the leading portion of the second medium or the leading portion of the first medium and the trailing portion of the second medium as indicated by block 194. Method 178 may additionally or alternatively include decelerating the second medium to eliminate the overlap of the trailing portion of the first medium and the leading portion of the second medium, as indicated by block 196, and/or stopping the second medium to eliminate the overlap of the trading portion of the first medium and the leading portion of the second medium, as indicated by block 198. Method 178 may further or alternatively include accelerating the second medium into a duplex portion of the media path to reduce the overlap between the trailing portion of the first medium and the leading portion of the second medium, as indicated by block 200.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A media handling system for use in a printing device, comprising:

a media path including a print zone portion, a duplex portion, and an output portion;

a transport assembly to move print media through the media path;

a processor;

a non-transitory storage medium including instructions that, when executed by the processor, cause the processor to control the transport assembly to:

move a first medium through the media path;

move a second medium through the media path;

overlap a trailing portion of the first medium and a leading portion of the second medium within the media path;

overlap a leading portion of the first medium and a trailing portion of the second medium within the media path; and overlap the trailing portion of the first medium and the leading portion of the second medium during a time that the leading portion of the first medium and the trailing portion of the second medium is also overlapped to increase a rate of printing of the printing device.

2. The media handling system of claim 1, wherein the non-transitory storage medium includes additional instructions that, when executed by the processor, cause the processor to control the transport assembly to:

move one of the first medium and the second medium through the print zone portion of the media path during a period of overlap of one of the trailing portion of the first medium and the leading portion of the second medium and the leading portion of the first medium and the trailing portion of the second medium.

3. The media handling system of claim 1, wherein the non-transitory storage medium includes additional instructions that, when executed by the processor, cause the processor to control the transport assembly to:

decelerate the second medium to eliminate the overlap of the trailing portion of the first medium and the leading portion of the second medium.

4. The media handling system of claim 1, wherein the non-transitory storage medium includes additional instructions that, when executed by the processor, cause the processor to control the transport assembly to:

stop the second medium to eliminate the overlap of the trailing portion of the first medium and the leading portion of the second medium.

5. The media handling system claim 1, wherein the non-transitory storage medium includes additional instructions that, when executed by the processor, cause the processor to control the transport assembly to:

accelerate the second medium into the duplex portion of the media path to reduce the overlap between the trailing portion of the first medium and the leading portion of the second medium.

6. The media handling system of claim 1, wherein a combined length of the first medium and the second medium are greater than a length of the media path.

7. The media handling system of claim 1, further comprising a passive buffer where the first medium and second medium overlap.

8. The media handling system of claim 7, wherein the passive buffer is located in the duplex portion of the media path.

9. The media handling system of claim 1, wherein the first medium and the second medium overlap in the output portion of the media path.

10. A media handling method, comprising:

moving a first medium through a media path in a printing device;

moving a second medium through the media path in the printing device;

overlapping within the media path a trailing portion of the first medium and a leading portion of the second medium;

overlapping within the media path a leading portion of the first medium and a trailing portion of the second medium; and controlling the overlap of the trailing portion of the first medium and the leading portion of the second medium to occur during a time that the overlap of the leading portion of the first medium and the trailing portion of the second medium occurs to increase a rate of printing of the printing device.

11. The method of claim 10, further comprising:

moving one of the first medium and the second medium through a print zone of the printing device during a period of overlap of one of the trailing portion of the first medium and the leading portion of the second medium and the leading portion of the first medium and the trailing portion of the second medium.

12. The method of claim 10, further comprising:

decelerating the second medium to eliminate the overlap of the trailing portion of the first medium and the leading portion of the second medium.

13. The method of claim 10, further comprising:

stopping the second medium to eliminate the overlap of the trailing portion of the first medium and the leading portion of the second medium.

14. The method of claim 10, further comprising:

accelerating the second medium into a duplex portion of the media path to reduce the overlap between the trailing portion of the first medium and the leading portion of the second medium.

15. The method of claim 10, wherein the first medium is moved through a print zone portion of the media path to an output portion of the media path, and then moved through a duplex portion of the media path to the print zone portion for a second time, and further wherein the second medium is in the duplex portion of the media path the second time the first print medium is moved through the print zone.

16. A non-transitory storage medium including instructions that, when executed by a processor, cause the processor to control a media handling system of a printing device to:

move a first medium through a media path in the printing device:

move a second medium through the media path in the printing device;

overlap within the media path a trailing portion of the first medium and a leading portion of the second medium;

overlap within the media path a leading portion of the first medium and a trailing portion of the second medium; and control the overlap of the trailing portion of the first medium and the leading portion of the second medium to occur during a time that the overlap of the leading portion of the first medium and the trailing portion of the second medium occurs to increase a rate of printing of the printing device.

17. The non-transitory storage medium of claim 16, further comprising instructions that, when executed by the processor, cause the processor to control the media handling system of the printing device to:

move one of the first medium and the second medium through a print zone of the printing device during a period of overlap of one of the trailing portion of the first medium and the leading portion of the second medium and the leading portion of the first medium and the trailing portion of the second medium.

18. The non-transitory storage medium of claim 16, further comprising instructions that, when executed by the processor, cause the processor to control the media handling system of the printing device to:

decelerate the second medium to eliminate the overlap of the trailing portion of the first medium and the leading portion of the second medium.

19. The non-transitory storage medium of claim 16, further comprising instructions that, when executed by the processor, cause the processor to control the media handling system of the printing device to:

stop the second medium to eliminate the overlap of the trailing portion of the first medium and the leading portion of the second medium.

20. The non-transitory storage medium of claim 16, further comprising instruction that, when executed by the processor, cause the processor to control the media handling system of the printing device to:

accelerate the second medium into a duplex portion of the media path to reduce the overlap between the trailing portion of the first medium and the leading portion of the second medium.

* * * * *